US006074052A

United States Patent [19]

Inui et al.

[11] Patent Number: 6,074,052

[45] Date of Patent: Jun. 13, 2000

[54] INK JET PRINTING METHOD AND INK JET RECORDING APPARATUS

[75] Inventors: Toshiharu Inui, Yokohama; Tetsurou Inoue, Tokyo; Noribumi Koitabashi, Yokohama; Kentaro Yano, Yokohama; Masaya Uetsuki, Yokohama; Daigoro Kanematsu; Hidehiko Kanda, both of Kawasaki; Yoshinori Nakajima, Yokohama, all of Japan

[73] Assignee: Canon Kabushiki Kaisha, Tokyo, Japan

[21] Appl. No.: 08/840,773

[22] Filed: Apr. 16, 1997

[30] Foreign Application Priority Data

| | | | |
|---|---|---|---|
| Apr. 19, 1996 | [JP] | Japan | 8-098927 |
| Mar. 27, 1997 | [JP] | Japan | 9-075497 |

[51] Int. Cl.[7] ..... B41J 2/01

[52] U.S. Cl. ..... 347/101; 347/96; 347/98

[58] Field of Search ..... 347/96, 98, 101

[56] References Cited

U.S. PATENT DOCUMENTS

| | | | |
|---|---|---|---|
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,746,935 | 5/1988 | Allen | 347/96 |
| 5,208,605 | 5/1993 | Drake | 347/47 |
| 5,488,398 | 1/1996 | Matsubara et al. | 347/43 |
| 5,549,740 | 8/1996 | Takahashi et al. | 106/20 R |
| 5,635,969 | 6/1997 | Allen | 347/96 |
| 5,805,190 | 9/1998 | Tsuchii et al. | 347/100 |

FOREIGN PATENT DOCUMENTS

| | | |
|---|---|---|
| 657849A2 | 6/1995 | European Pat. Off. . |
| 699535A2 | 3/1996 | European Pat. Off. . |
| 706889A1 | 4/1996 | European Pat. Off. . |
| 54-56847 | 5/1979 | Japan . |
| 56-84992 | 7/1981 | Japan . |
| 59-123670 | 7/1984 | Japan . |
| 59-138461 | 8/1984 | Japan . |
| 60-71260 | 4/1985 | Japan . |
| 64-63185 | 3/1989 | Japan . |
| 03-146355 | 6/1991 | Japan . |
| 04-158049 | 6/1992 | Japan . |
| 07-195823 | 8/1995 | Japan . |

*Primary Examiner*—John Barlow
*Assistant Examiner*—Christina Annick
*Attorney, Agent, or Firm*—Fitzpatrick, Cella, Harper & Scinto

[57] ABSTRACT

A method and an apparatus for ink jet printing use a print head including a first nozzle group for discharging a first ink, a second nozzle group for discharging a second ink and a third nozzle group for discharging a printability improving solution. The third nozzle group is displaced between the first nozzle group and the second nozzle group. The first nozzle group discharges the first ink on the printing medium based on image data to form an image, the third nozzle group discharges the printability improving solution on the image formed on the printing medium by means of another step, and the second nozzle group discharges the second ink on the image formed on the printing medium. The printability improving solution has higher penetrability into the printing medium compared to the ink.

The method and apparatus can attain a clear colored, high density image without color mixing, which has high water resistance on plain paper, with a low running cost.

25 Claims, 11 Drawing Sheets

INK JET PRINTING METHOD AND INK JET RECORDING APPARATUS

BACKGROUND OF THE INVENTION

1. Field of the Invention

The present invention relates to methods and apparatus for ink jet printing capable of high quality image formation on printing materials. In particular, the present invention relates to a method and apparatus for ink jet printing which discharges a liquid which can insolubilize or precipitate coloring materials in inks.

The present invention is applicable to all instruments and devices, e.g. printers, copying machines and facsimiles, using various recording materials, such as paper, cloth, nonwoven fabric and transparency sheets for over head projectors (OHP sheets).

2. Description of the Related Art

Ink jet recording apparatus are capable of high density and high speed recording operations on various printing materials, such as paper, cloth, plastic films and OHP sheets, and have been practically used in output means of information processing systems, e.g. printers of copying machines, facsimiles, electron typewriters, word processor and work stations and handy or portable printers provided with personal computers, host computers, optical disk devices and video devices.

Each ink jet recording apparatus has its own configuration depending on the characteristic function of the apparatus and the operation circumference. A typical ink jet recording apparatus is provided with a carriage bearing a recording means, i.e., a print head, and an ink vessel; a transfer means for transferring recording materials; and a controlling means for controlling them. The print head which discharges ink droplets from a plurality of discharging nozzles is serially scanned along the main scanning direction perpendicular to the sub-scanning direction, in which a recording material travels, while intermittently carrying the recording material in response to non-recording regions. This process includes recording with ink droplets discharged on the recording material in response to recording signals and has practical advantages, for example, low running costs and low printing noise. A multiple print head having many ink discharging nozzles along the sub-scanning direction in a straight line can record a width corresponding to the nozzle array every scan on the recording material, and enables high speed recording operation.

Recently, an apparatus, which uses three or four color print heads and is capable of full color image formation, has been practically used. Such an apparatus is provided with three or four print heads and ink vessels corresponding to three primary colors of yellow (Y), magenta (M) and cyan (C), or four inks of these three primary colors and black (B).

Conventional ink jet printing methods and apparatus have unresolved issues, i.e., prevention of color mixing between black (B), yellow (Y), magenta (M) and cyan (C), high density black image formation, and prevention of feathering or bleeding. Improvement in one of these areas typically makes other problems worse. Therefore, these methods and apparatuses barely achieve high quality color printing which can respond to user's needs, as set forth below in detail.

Printing of a color image on plain paper by an ink jet printing process generally uses three or four fast set inks which can rapidly penetrate into plain paper. The fast set inks do not bleed at boundary regions of different colors in a color image, but they exhibit a low color density at each black image section and a low coloring characteristic at each colored image section other than black. Further, printing of line images such as characters causes ink bleeding along paper fibers or so-called feathering. In particular, characters of a black ink have noticeable feathering compared to those of other color inks, and are blurred and unclear. As a result, the overall quality of the recorded image is unsatisfactorily decreased.

A high quality image having a high black image density without feathering on plain paper generally requires a considerable amount of discharge of an ink having a relatively low penetration speed. However, this method forms color mixing between the black ink and other color inks at each boundary between black image sections and other color image sections, resulting in noticeable deterioration of the recorded image quality.

Practical examples for solving such drawbacks include promotion of ink drying by a heater provided in the recording apparatus. Although this method can form a color image having high coloring characteristics without bleeding or feathering, a large size apparatus accompanied by an increased cost is necessary.

Prevention of color mixing between black and color inks, high density black image formation, and prevention of feathering or bleeding are goals that are difficult to achieve simultaneously, as described above.

Japanese Unexamined Patent Publication No: 3-146,355 discloses a method in which regions along boundaries between black and other color sections are not recorded. This method, however, deforms the recorded data.

Japanese Unexamined Patent Publication No. 4-158,049 discloses a method in which images are recorded with a plurality of color heads and a character print head by switching these heads in response to the image to be recorded. However, a black image recorded with any color head is different from a black image recorded with the character print head, due to quality differences between the heads.

Another method for preventing bleeding at boundaries between black and color sections includes formation of black regions along the boundaries by means of superposition printing with color inks. A black color is also obtainable by superposing or mixing three colors (Y, M and C), but it appears faded.

Japanese Unexamined Patent Publication Nos. 56-84,992 and 64-63,185 disclose methods which use liquids for insolubilizing dyes in inks. In Japanese Unexamined Patent Publication No. 56-84,992, a material for fixing dyes is previously applied to a recording material. However, this method requires a particular recording paper, a large apparatus accompanied by an increased cost, and still leaves an unsolved problem in that it is difficult to stably apply the material for fixing dyes to the recording material of a given thickness.

Japanese Unexamined Patent Publication No. 64-63,185 discloses a technology for adhering a colorless ink to insolubilize dyes to the recording material with an ink jet print head. According to this technology, the dot size of the colorless ink is larger than that of inks for image formation, and thus the resulting image quality is satisfactory even if the printed positions of the colorless ink and the inks for image formation shift with respect to each other. However, a relatively large amount of colorless ink is discharged to a position at which an image is formed. Therefore, a longer time period for drying is required, and the resulting image is occasionally unclear.

Japanese Unexamined Patent Publication No. 7-195,823 achieves single-pass color printing in which a colorless precursor is applied to a surface of a recording material before ink jet recording.

In each image forming process using a colorless liquid to insolubilize dyes in inks and inks containing dyes, no method for controlling penetration speeds of these inks into the recording material to achieve a high quality image is disclosed or suggested.

SUMMARY OF THE INVENTION

It is an object of the present invention to provide a method and apparatus of ink jet printing which use a liquid containing a material solubilizing or precipitating coloring materials in inks, exhibit excellent water resistance on plain paper, provide a high density image and provide a clear color image without color mixing between different colors in color recording.

It is another object of the present invention to provide a method and apparatus of ink jet printing which use inks and the above-mentioned liquid, exhibit excellent fixing characteristics of the inks and liquid on a printing medium, and provide a high quality image.

In accordance with one aspect of the present invention, a method for ink jet printing comprises:

providing an ink jet printing apparatus for forming an image using a print head comprising:

a first nozzle group for discharging a first ink to develop a first color;

a second nozzle group for discharging a second ink to develop the first color;

a third nozzle group for discharging a printability improving solution having a higher penetrability into a printing medium compared to the first ink and the second ink, to improve the printability of the first ink and the second ink;

the first nozzle group through the third nozzle group being arranged along a relative moving direction of the print head to the printing medium, the third nozzle group being arranged between the first nozzle group and the second nozzle group;

a first step for forming an image by discharging the first ink from the first nozzle group onto the printing medium based onto image data;

a second step for discharging the printability improving solution from the third nozzle group onto the image formed in the first step on the printing medium based on the image data; and a third step for discharging the second ink from the second nozzle group onto the image formed in the second step on the printing medium based on the image data.

The first ink and the second ink may have the same composition, or different compositions.

Another aspect of the present invention relates to an ink jet printing apparatus for forming an image comprising a print head comprising:

a first nozzle group for discharging a first ink to develop a first color;

a second nozzle group for discharging a second ink to develop the first color;

a third nozzle group for discharging a printability improving solution having a higher penetrability into a printing medium compared to the first ink and the second ink to improve printability of the first ink and the second ink;

the first nozzle group through the third nozzle group being arranged in a relative moving direction of the print head to the printing medium, the third nozzle group being arranged between the first nozzle group and the second nozzle group;

wherein the ink jet printing apparatus further comprises a control unit for controlling the discharge operation of the first through third nozzle groups such that the first nozzle group discharges the first ink onto the printing medium based on image data to form an image;

the third nozzle group discharges the printability improving solution onto the image formed on the printing medium based on the image data; and the second nozzle group discharges the second ink onto the image formed on the printing medium based on the image data.

A further aspect of this invention relates to a method for ink jet printing by discharging an ink containing a coloring material onto a printing medium comprising:

a step for discharging the ink onto a given section of the printing medium based on image data;

a step for discharging a liquid onto the given section of the printing medium based on the image data, the liquid containing a material to insolubilize or coagulate a coloring material in the ink, having high penetrability into the printing medium relative to the ink, and having a surface tension $\gamma$ (dyn/cm) within a range of $30 \leqq \gamma \leqq 40$; and a step for discharging an ink onto the given section of the printing medium based on the image data.

Still another aspect of this invention relates to an ink jet printing apparatus for performing printing by discharging an ink containing a coloring material onto a printing medium comprising:

an ink discharge section for discharging the ink onto the printing medium;

a liquid discharge section for discharging a liquid onto the printing medium, the liquid containing a material to insolubilize or coagulate a coloring material in the ink, having high penetrability into the printing medium relative to the ink, and having a surface tension $\gamma$ (dyn/cm) within a range of $30 \leqq \gamma \leqq 40$; and a discharge controlling section for controlling discharge of the ink from the ink discharge section onto a given section of the printing medium based on image data, and discharge of the liquid from the liquid discharge section onto the given section of the printing medium based on the image data.

In the present invention, the "printability improving solution" means a solution containing a material which insolubilizes or coagulates a coloring material contained in a ink. "improvement in printability" refers to improvement in image quality, such as density, color saturation, sharpness at edges and dot sizes; improvement in ink fixing characteristics; and improvement in image stability, such as water resistance and light resistance.

"Insolubilization" in the present invention means a phenomenon in which anionic groups contained in a dye in an ink interact with cationic groups contained in a cationic material in the printability improving solution to form ionic bonds and the coloring material or dye homogeneously dissolved in the ink segregates from the solution. The improvement in color density, character quality and fixing characteristics can be achieved even when less than all the dye in the ink is not insolubilized.

The term "coagulation" or "aggregation" in the present invention is used when a water-soluble dye having an anionic group is used in an ink, and has the same meaning as insolubilization. Further, when a pigment is used as a coloring material of the ink, coagulation or aggregation means a significant increase in pigment particle size due to dispersion destruction which is caused by ionic interaction between a pigment dispersant or pigment surface and cationic groups in the printability improving solution. The ink viscosity generally increases together with such coagulation. The improvements in color density, character quality and fixing characteristics can be achieved even when less than all the pigment in the ink coagulates.

DETAILED DESCRIPTION OF THE PREFERRED EMBODIMENTS

Figure 1:
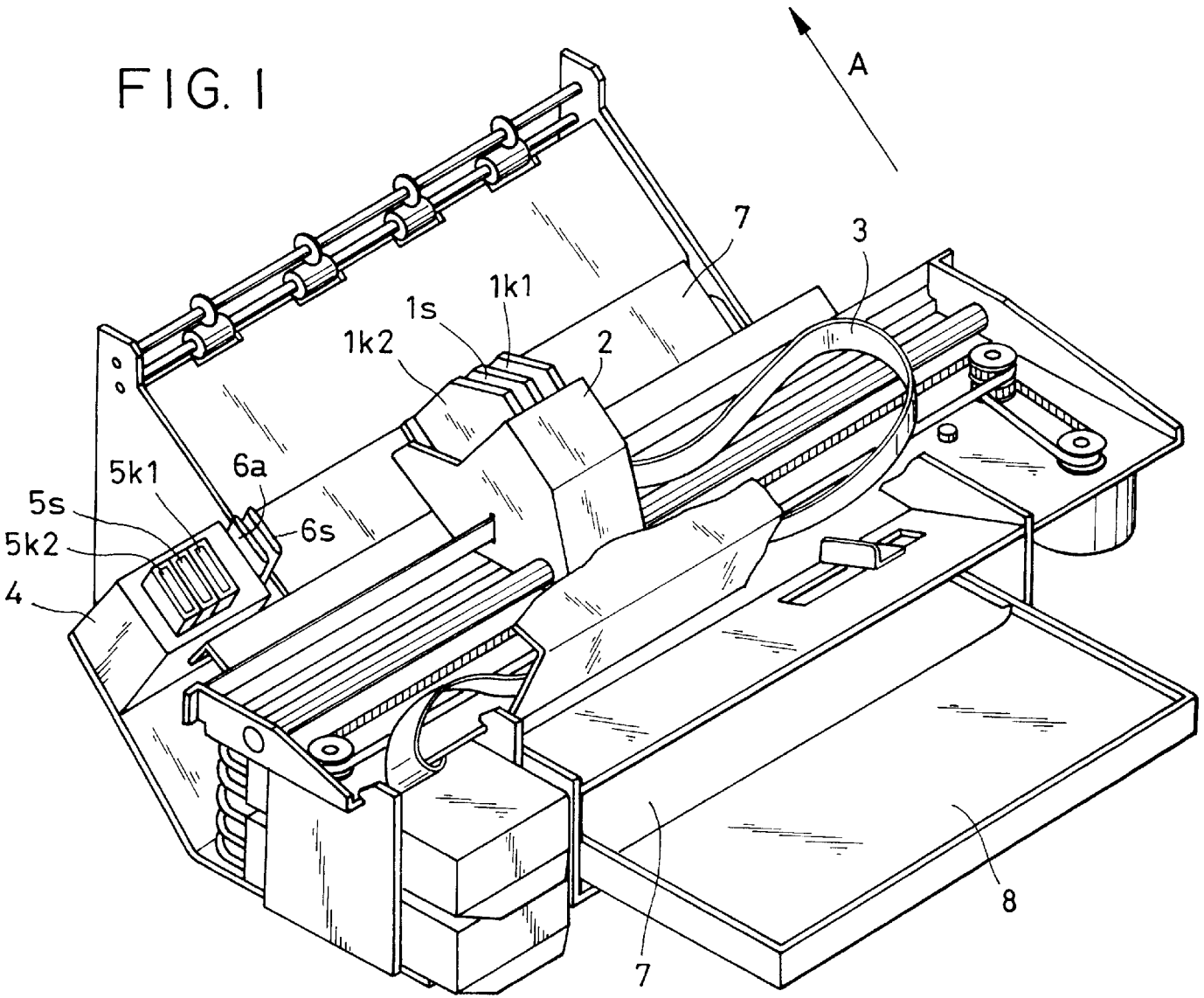
FIG. 1 is a perspective view of a printer in accordance with a first embodiment of the present invention.

The present inventors have intensively investigated penetrability of a liquid to insolubilize a coloring material in ink and the ink containing the coloring material, and the order of discharge of the liquid and the ink on a printing medium, for the purpose of obtaining a high quality image due to excellent fixing of the ink to the printing medium, and have attained the following knowledge.

A superimposing-type ink with low penetrability to a printing material is generally used for obtaining a high quality image. When a liquid which insolubilizes a coloring material in the ink (hereinafter referred to as a printability improving solution) having low penetrability to the printing medium is used together with the ink, fixing characteristics on the printing medium deteriorate. A fine mist composed of a mixture of the ink and the printability improving solution readily forms during discharge on the printing medium, and adheres to the nozzle face of a recording head. Thus, the discharging direction of the ink and printability improving solution will be deflected or the ink and the printability improving solution will not be discharged on occasion, resulting in deterioration in printing reliability.

When an ink with low penetrability to the printing medium and a printability improving solution with high penetrability are used in combination, the initially discharged printability improving solution readily bleeds out on the printing medium, and thus the ink discharged thereon also bleeds out along the bled stream of the printability improving solution (feathering), resulting in deterioration in image quality.

A combination of an ink with high penetrability to the printing medium and a printability improving solution with low penetrability also causes feathering and decreased image quality. Also, a combination of an ink with high penetrability and a printability improving solution with high penetrability readily causes feathering which decreases image quality.

In contrast, with a combination of an ink with low penetrability to the printing medium and a printability improving solution with high penetrability, satisfactory image formation is achieved by the following discharge process. The ink is discharged to a given position on the printing medium, the printability improving solution is discharged to the same position, then the ink is discharged to the same position again. This process provides excellent fixing characteristics and a high image quality due to decreased feathering, and generates little fine mist composed of the ink and the printability improving solution. Plausible reasons to explain such effects are as follows. Discharge of an ink with low penetrability on a printing medium forms a state with little feathering on the printing medium. A printability improving solution with high penetrability discharged on the same position does not readily bleed out due to blocking effects of the ink with low penetrability, whereas the printability improving solution exhibits excellent short-time fixing characteristics due to its high penetrability. A coloring material in an additional ink with low penetrability, which is discharged on the same position, barely penetrates into the printing medium and remains on the surface of the printing medium. A high density image can thereby be obtained. In the discharge process, in which the printability improving solution with high penetrability is discharged on the same position on the recording medium between two discharges of the ink with low penetrability, the ink is practically not affected by the printability improving solution, and thus a high quality image with little feathering is obtainable.

Embodiments of the present invention will now be described with reference to the drawings.

[Embodiment 1]

FIG. 1 is a perspective view of an ink jet printer (hereinafter referred to as printer) as an embodiment of an ink jet printing apparatus in accordance with the present invention. The printer is provided with a carriage loaded with a print head 1*s* for discharging a printability improving solution and two print heads 1*k*1 and 1*k*2 for discharging a black ink, a flexible cable 3 for transmitting electrical signals from the printer main body to the print heads, a cap unit 4 with a recovery means, and a paper feeding tray 8 for feeding a printing material 7. The print head 1*s* is provided between the two print heads 1*k*1 and 1*k*2. The cap unit 4 is provided with caps 5*s*, 5*k*1 and 5*k*2, which correspond to the print heads 1*s*, 1*k*1 and 1*k*2, respectively, a wiper blade 6*s* corresponding to the print head 1*s*, and a wiper blade 6*a* corresponding to the print heads 1*k*1 and 1*k*2, wherein the wiper blades 6*s* and 6 are made of rubber or the like. The print heads 1*s*, 1*k*1 and 1*k*2 serially scan in the main scanning direction perpendicular to the carrying direction A of the recording material to record a region with a width determined by the number of nozzles, while intermittently carrying the recording material in response to non-recording regions. Each of the print heads 1*s*, 1*k*1 and 1*k*2 has 64 nozzles, and each nozzle can discharge approximately 40 ng of printability improving solution or ink.

Figure 2:
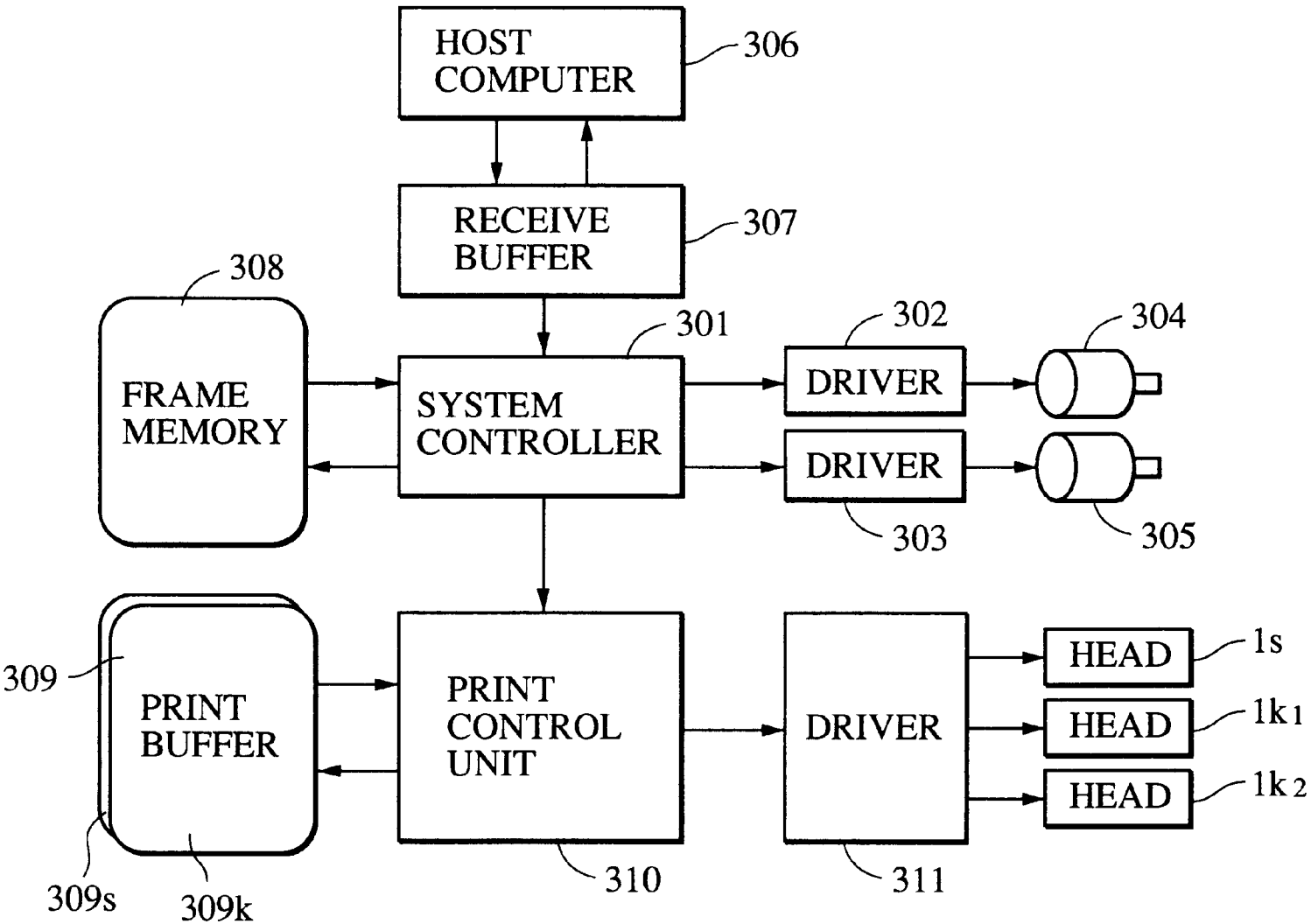
FIG. 2 is a block diagram illustrating electrical control of the printer of FIG. 1.

FIG. 2 is a block diagram illustrating electrical control of the ink jet printer described above. A system controller 301 comprehensively controls the apparatus and includes a microprocessor unit, a ROM unit for storing control programs and a RAM unit used in operation. A driver 302 submits signals for driving the print heads 1*s*, 1*k*1 and 1*k*2 in the main scanning direction to a motor 304, and a driver 303 submits signals for driving the recording material in the sub-scanning direction to a motor 305. The drivers 302 and 305 submit information including speed, travelling distance, and the like to the motors 304 and 305, respectively.

A host computer 306 submits information regarding printing to the printing apparatus of the present invention. The host computer 306 is connected to a receive buffer 307, which temporarily stores data from the host computer 306 until the system controller 301 reads the data. The system controller 301 is connected to a frame memory 308 which converts printing information to image data and has a memory size sufficient for printing. In this embodiment, the frame memory has a memory size capable of storing image data corresponding to a sheet of printing paper, but the memory size is not limited to this. A print buffer 309, comprising a buffer memory unit 309*k* for a black ink printing buffer and a buffer memory unit 309*s* for a printability improving solution printing buffer, temporarily stores data to be printed and the memory size of the print buffer 309 depends on the number of nozzles of the print heads. A print control unit 310 controls print heads based on commands regarding print speed and number of printed data from the system controller 301, and generates data for discharging the printability improving solution. The print control unit 310 submits these data to a driver 311 which drives the print head 1*s* for discharging the printability improving solution, and print heads 1*k*1 and 1*k*2 for discharging the black ink.

The receive buffer 307 reads and temporarily stores image data from the host computer 306. The system controller 301 reads the stored image data from the receive buffer 307 and submits it to the print buffer 309 through the print control unit 310. The print control unit 310 generates data for discharging the printability improving solution based on the data stored in the print buffer 309, and controls movement of the print heads based on the image data and printability improving solution data in the print buffer 309.

In this embodiment, the following black ink and printability improving solution are used. The black ink has a surface tension of 48 dyne/cm, and the printability improving solution has a surface tension of 35 dyne/cm, wherein the surface tension is used as an index of penetrability.

| (Black Ink) | |
|---|---|
| Glycerin | 5 parts by weight |
| Thiodiglycol | 5 parts by weight |
| Urea | 5 parts by weight |
| Isopropyl alcohol | 4 parts by weight |
| C.I. Direct Black 154 | 3 parts by weight |
| Water | 78 parts by weight |
| (Printability improving solution) | |
| Polyarylamine hydrochloric acid salt | 1 parts by weight |
| Tributylamine chloride | 1 parts by weight |
| Thiodiglycol | 10 parts by weight |
| Acetylenol | 0.5 parts by weight |
| Water | 87.5 parts by weight |

In this embodiment, the same image data is fed to the print heads 1*s*, 1*k*1 and 1*k*2 to discharge the printability improving solution and black ink. Each print head has a discharge capacity of approximately 40 ng, and thus the ratio of the printability improving solution to the black ink is 1:2 (50%).

Figure 3A:
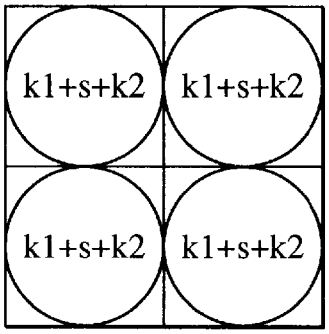
FIGS. 3A through 3D are schematic plan views illustrating a process which discharges inks and a printability improving solution on recording pixels.
Figure 3B:
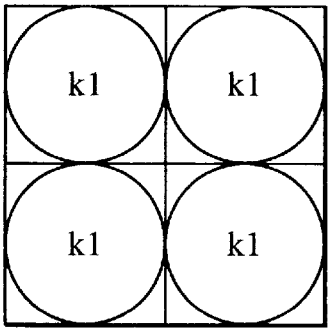
Figure 3C:
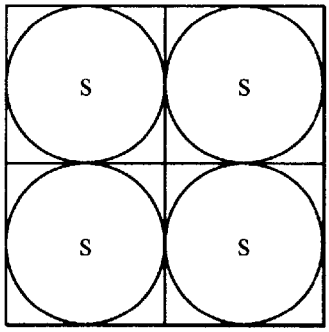
Figure 3D:
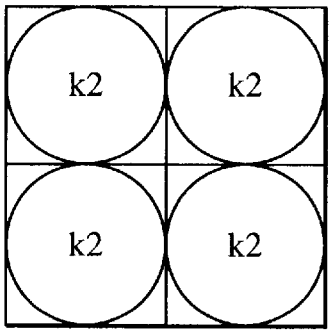

FIGS. 3A through 3D are schematic plan views illustrating an example of a process which discharges the black ink and the printability improving solution on each pixel. FIG. 3A shows a result in which the black ink is discharged from print heads 1*k*1 and 1*k*2 and the printability improving solution is discharged from the print head 1*s* to each 2 by 2 pixel. In order to print the image shown in FIG. 3A, first the black ink is discharged from the print head 1*k*1 as shown in FIG. 3B, then the printability improving solution is discharged from the print head 1*s* on the same pixels as shown in FIG. 3C, and finally the black ink is discharged from the black head 1*k*2 to the same pixels as shown in FIG. 3D. The image formation shown in FIG. 3A using the black ink and printability improving solution is completed thereby.

In this embodiment, a sharp black image having high density with little feathering is obtained and exhibits high water resistance. The resulting black image has the same high quality in both normal and reverse scanning directions.

[Embodiment 2]

In this embodiment, the print heads 1*k*1 and 1*k*2 in the ink jet printing apparatus used in Embodiment 1 have different discharge volumes, that is, the discharge volume of the print head 1*k*1 is larger than that of the print head 1*k*2 in order to shorten the fixing time after image formation. This procedure can prevent thickening of the previously discharged black ink by the reaction with the succeedingly discharged printability improving solution. Such thickening causes an increased drying time period for the black ink which is finally discharged. It is preferable that the discharge volume of the print head 1*k*1 be slightly increased in order to prevent the decreased recording density of the final image.

These discharge volumes can be controlled by, for example, changing the driving conditions which are submitted to heaters provided in the print heads.

Figure 4A:
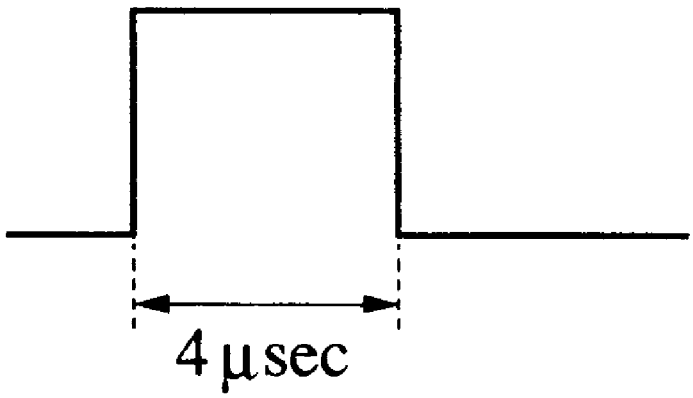
FIGS. 4A and 4B are waveform diagrams of pulse waveforms which are applied to a heater in a print head.
Figure 4B:
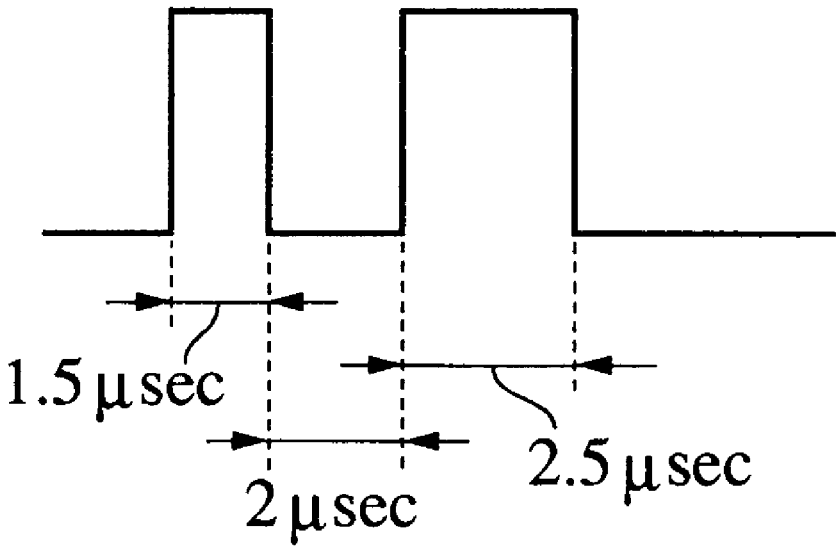

FIGS. 4A and 4B show pulse waveforms which are submitted to the heaters of the print heads. FIG. 4A shows a 4 μsec single pulse and FIG. 4B shows a double pulse sequence composed of a 1.5 μsec pre-pulse and a 2.5 μsec main pulse submitted after a 2.0 μsec inactive time. The single pulse has a discharge volume of approximately 38 ng, and the double pulse has a discharge volume of approximately 42 ng. The pulse conditions shown in FIGS. 4A and 4B have the same energizing time period, but can be changed to vary the discharge volumes of the two heads.

In this embodiment, the double pulse is impressed on print head 1*k*1, and the single pulse is impressed on print head 1*k*2. Such a pulse combination can form a sharp, high density image with a shorter fixing time than Embodiment 1.

When the pulse conditions impressed on print heads 1*k*1 and 1*k*2 during normal scanning are interchanged during reverse scanning, the discharge volume of the black ink which is discharged first can always be set to be larger than that of the black ink which is discharged after the discharge of the printability improving solution, in both normal and reverse directions. Bidirectional printing can be achieved in such a manner.

Another means for varying the discharge volumes is to change the print head configuration. Each discharge volume of the print heads 1*k*1 and 1*k*2 depends on the size of the print head heater and the nozzle structure. For example, a larger heater increases the discharge volume, and a nozzle having larger discharge openings also increases the discharge volume. Other heater configurations including any combination of modifications can be modified to vary the discharge volumes. However, change in the discharge volume according to the method described above is not applicable to bidirectional printing because each nozzle has a non-variable discharge volume in the normal and reverse directions.

[Embodiment 3]

This embodiment uses the same ink jet printing apparatus as Embodiment 1, but the discharge rate of print head 1*k*2 is set to be lower than that of print head 1*k*1, in order to improve the reliability of the operation using both the ink and the printability improving solution.

The reaction due to contact of the ink with the printability improving solution on the discharge face of each print head causes deposition of the reaction product on the discharge face. This adversely affects printing reliability due to image deterioration because of deflection of discharged ink droplets and discharge obstruction of the ink due to clogging of the discharge face. A possible cause of the reaction on the discharge face is ink and printability improving solution rebounding from the printing material occurring during discharge. The rebound state will be described in detail with reference to schematic views in FIGS. 5A through 5C.

Figure 5A:
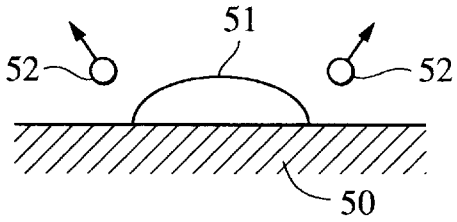
FIGS. 5A through 5C are schematic cross-sectional views illustrating rebound of inks and a printability improving solution which are discharged onto a recording material.

FIG. 5A illustrates rebounding ink or printability improving solution 51 discharged on a printing material 50, in which droplets 52 formed by the rebound splash toward the discharge face (not shown in the drawings) of a print head facing the printing material 50. Since an ink is discharged first in the present invention, the rebounding droplets are of the ink.

Figure 5B:
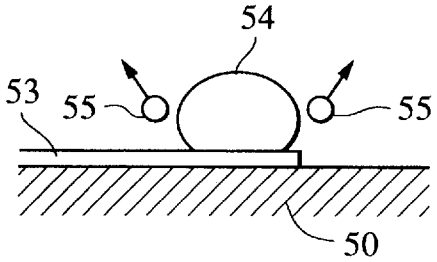

FIG. 5B illustrates rebound of the printability improving solution discharged on the printing material 50 after ink discharge. The printability improving solution 54 is discharged on the ink layer 53 previously formed, and droplets 55 formed by the rebound also splash toward the discharge face of the print head facing the printing material 50.

Figure 5C:
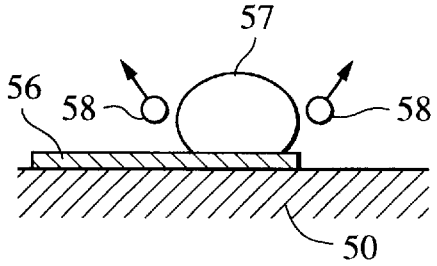

FIG. 5C illustrates rebound of the ink which is discharged on the printing material 50 again after the discharge of the printability improving solution. The ink 57 is discharged on the liquid mixture layer 56 composed of the ink and printability improving solution, and droplets 58 formed by the rebound also splash toward the discharge face of the print head facing the printing material 50.

Although the rebounded droplets 52 in FIG. 5A are composed of the ink, the rebounded droplets 55 and 58 in FIGS. 5B and 5C are not always solutions composed solely of the ink or solely of the printability improving solution. The present inventors discovered that the components of the rebounded droplets 55 and 58 depend on the characteristics of both the ink and printability improving solution and the order of discharge.

For example, when using the ink and printability improving solution in Embodiment 1, droplets 55 in FIG. 5B are mainly composed of the printability improving solution. As a result, only the printability improving solution adheres to the discharge face of print head 1*s* for the printability improving solution and does not cause deposition on the discharge face.

On the other hand, droplets 58 in FIG. 5C are mainly composed of the reaction product of the printability improving solution and the ink. As a result, the mixture of the printing improving solution and the ink adheres to print head 1*k*2 for the ink and causes ink deposition and clogging on the discharge face.

The present inventors experimentally discovered that droplet formation due to rebound can be greatly reduced by decreasing the discharge rate of the ink which is discharged last. Embodiment 3 is based on this principle.

Different discharge rates can be achieved as in Embodiment 2 wherein different discharge volumes are achieved. For example, a double pulse sequence may be applied to the heater of print head 1*k*1 and a single-pulse sequence may be applied to the heater of print head 1*k*2. Alternatively, print heads having different structures can achieve different discharge rates. The former method enables bidirectional printing by means of pulse sequence switching, but the latter can respond only to unidirectional printing, i.e., normal or reverse scanning.

The discharge face of the print head was observed after printing under conditions of an ink discharge rate for print head 1*k*1 of 16 m/s and an ink discharge rate for print head 1*k*2 of 12 m/s. A smaller amount of deposit was confirmed relative to Embodiment 1.

[Embodiment 4]

Figure 6A:
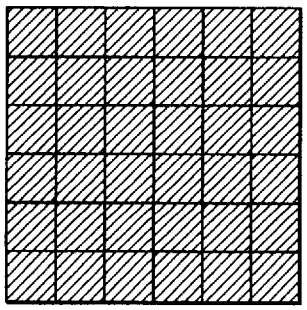
FIGS. 6A through 6C are schematic plan views of image data to be printed and decorative data in which black image data is eliminated.

In Embodiment 1, black image data is used for discharging the printability improving solution. Modified data which is obtained by curtailing the black image data may be used. Specifically, in Embodiments 1 through 3, the discharge pattern for the printability improving solution is the same as that for the black image, as shown in FIG. 6A. The printability improving solution can be discharged based on a modified pattern set forth in FIGS. 6B or 6C which corresponds to the curtailed black image data. The modified pattern may be either a regular curtailed pattern set forth in FIGS. 6B or 6C or an irregular curtailed pattern.

Figure 6B:
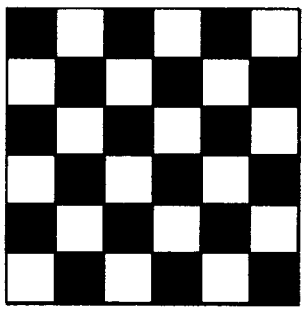
Figure 6C:
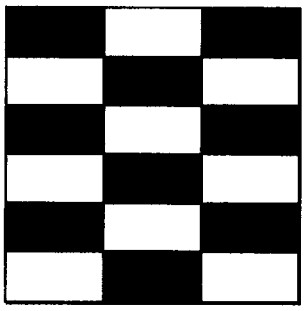

The curtailing rate is not limited to 50% as set forth in FIGS. 6A or 6B, but appropriately set depending on the desirable image quality, image characteristics such as water resistance, and combination of an ink and printability improving solution. For example, an increased polyacrylamine hydrochloric acid salt content in the printability improving solution, which increases reactivity with the ink, enables a reduced discharge volume of the printability improving solution due to a larger curtailing rate. Alternatively, the curtailing rate can be increased by using a water resistant dye as an ink coloring material.

[Embodiment 5]

Droplets formed by rebound of the discharged ink or printability improving solution are deposited on the discharge face of the head, resulting in decreased discharge reliability. In FIG. 5C, if the black ink and printability improving solution which have been previously discharged have penetrated into the printing material 50 and thus the liquid layer 56 does not have a large thickness when the black ink is discharged last, droplet formation due to rebound can be suppressed.

Therefore, the printability improving solution in this embodiment contains 1 percent by weight of acetylenol EH and has the same composition as in Embodiment 1 with respect to the other components in order to improve the penetrability of the printability improving solution into the printing material. The resulting printability improving solution has a surface tension of 30 dyn/cm. The discharge face of the print head was observed after printing using this printability improving solution. A smaller amount of deposit was confirmed relative to Embodiment 1.

[Embodiment 6]

Figure 7:
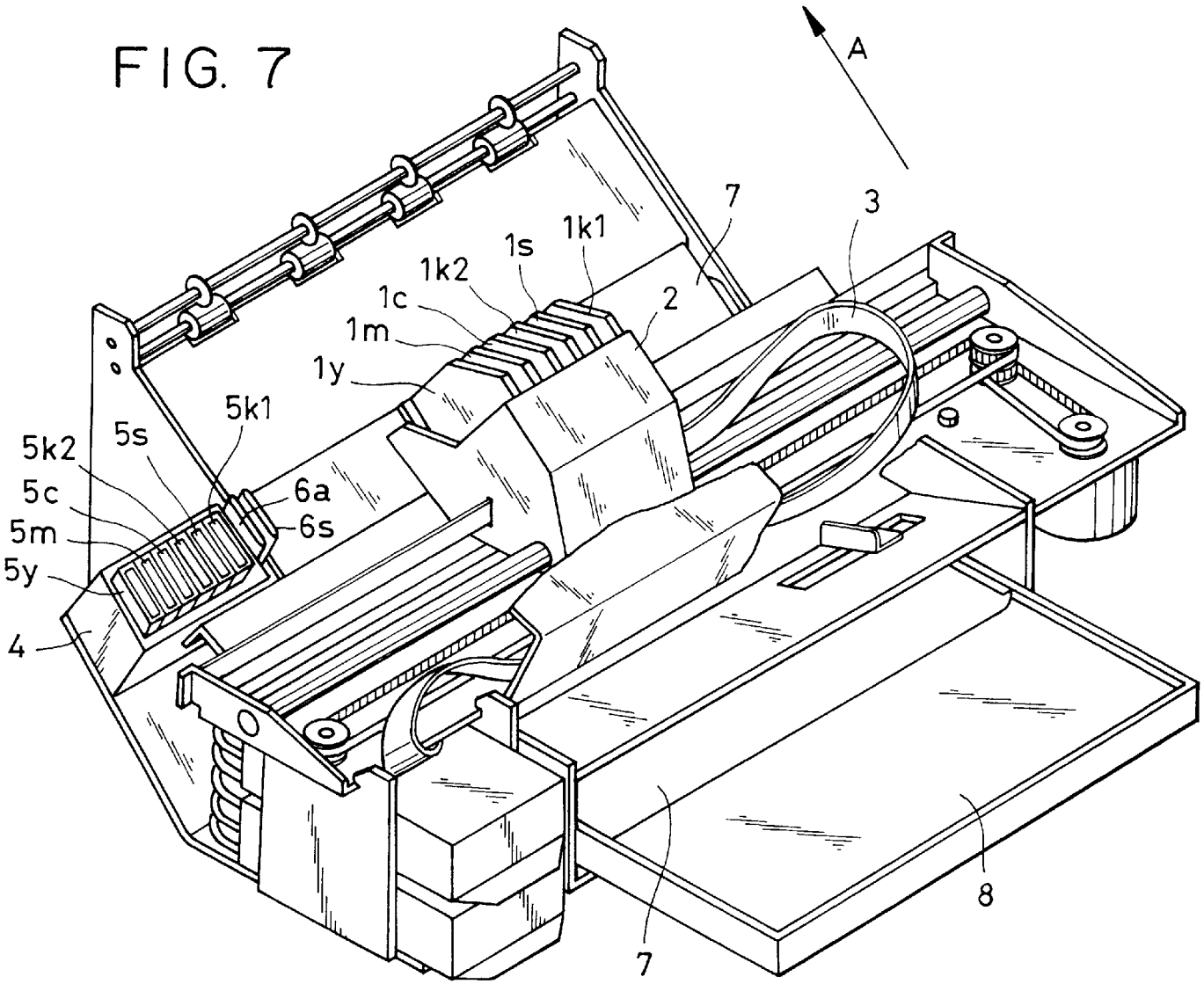
FIG. 7 is a perspective view of a printer in accordance with a sixth embodiment of the present invention.

FIG. 7 is a perspective view of a color ink jet printer as an ink jet printing apparatus in accordance with the present invention. This color ink jet printer has the same configuration as Embodiment 1 except that a plurality of print heads are provided. The color ink jet printer is provided with a print head 1*y* for yellow ink, a print head 1*m* for magenta ink, a print head 1*c* for cyan ink, print heads 1*k*1 and 1*k*2 for black ink, a print head 1*s* for printability improving solution, a carriage 2 for loading these print heads, a flexible cable 3 for submitting electrical signals from the printer main body to these printer heads, a cap unit 4 provided with a recovery means, capping means 5*y*, 5*m*, 5*c*, 5*k*2, 5*s* and 5*k*1 corresponding to print heads 1*y*, 1*m*, 1*c*, 1*k*2, 1*s* and 1*k*1, respectively, and a wiper blades 6*a* and 6*s* made of rubber or the like.

Each of print heads 1*y*, 1*m*, 1*c*, 1*k*2, 1*s* and 1*k*1 has 64 nozzles, and each nozzle discharges approximately 40 ng of ink or printability improving solution.

The following inks are used in this embodiment. The surface tension is 42 dyn/cm for the yellow ink, 42 dyn/cm for the magenta ink, 42 dyne/cm for the cyan ink, and 44 dyne/cm for the black ink. The printability improving solution employed in this embodiment is the same as in Embodiment 1.

(Ink)

| | |
|---|---|
| 1. Yellow Ink | |
| Triethylene glycol | 7 parts by weight |
| Hexane triol | 7 parts by weight |
| Isopropyl alcohol | 2.5 parts by weight |
| Acetylenol | 0.02 parts by weight |
| C.I. Direct Yellow 86 | 1.5 parts by weight |
| Water | 81.98 parts by weight |
| 2. Magenta Ink | |
| Triethylene glycol | 7 parts by weight |
| Hexane triol | 7 parts by weight |
| Isopropyl alcohol | 1.5 parts by weight |
| Acetylenol | 0.01 parts by weight |
| C.I. Acid Red 289 | 1.5 parts by weight |
| Water | 82.99 parts by weight |
| 3. Cyan Ink | |
| Triethylene glycol | 7 parts by weight |
| Hexane triol | 7 parts by weight |
| Isopropyl alcohol | 1.5 parts by weight |
| Acetylenol | 0.01 parts by weight |
| C.I. Direct Blue 199 | 2.5 parts by weight |
| Water | 81.99 parts by weight |
| 4. Black Ink | |
| Triethylene glycol | 6 parts by weight |
| Hexane triol | 6 parts by weight |
| Butyl alcohol | 2 parts by weight |
| Lithium acetate | 0.01 parts by weight |
| C.I. Direct Black 154 | 2.5 parts by weight |
| Water | 83.49 parts by weight |

Figure 8:
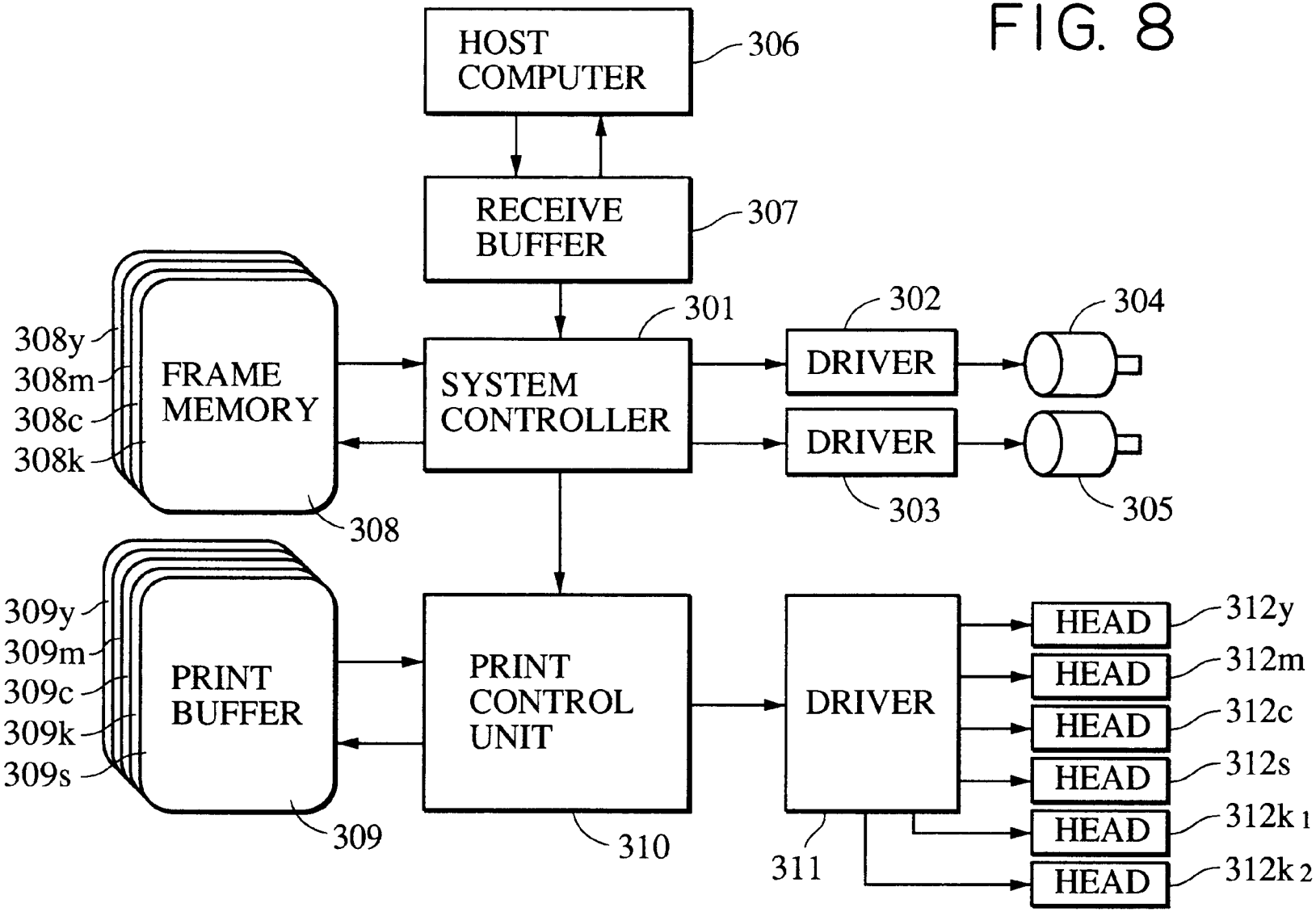
FIG. 8 is a block diagram illustrating electrical control of the printer of FIG. 7.

FIG. 8 is a block diagram illustrating electrical control of the color ink jet printer shown in FIG. 7. In FIG. 8, the same identification numbers are assigned to the same parts as in Embodiment 1 (FIG. 2). The electrical control functions are almost the same as in Embodiment 1.

In this embodiment, the printability improving solution is discharged so that the amount discharged onto a unit area corresponds to 50% of the amount of ink discharged on the unit area. As in Embodiment 1, after printing a black image with the print head 1*k*1 for black ink, the printability improving solution is discharged using the same data as the black image data and the black image is discharged with the print head 1*k*2 for black ink. In a color image section, after each of yellow, magenta and cyan data is curtailed 50% according to the color pattern set forth in FIG. 6B, a logical sum of these data is used for discharging the printability improving solution. Therefore, the printability improving solution is discharged based on the logical sum before color image formation.

Figure 9A:
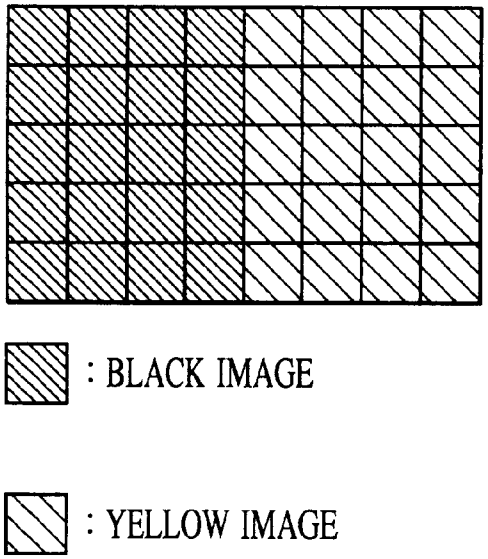
FIGS. 9A through 9C are schematic plan views of image data to be printed and decorative data in which black image data is eliminated.
Figure 9B:
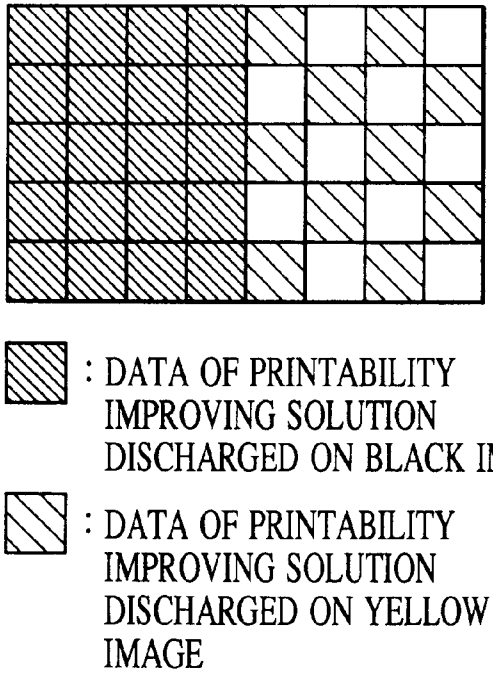
Figure 9C:
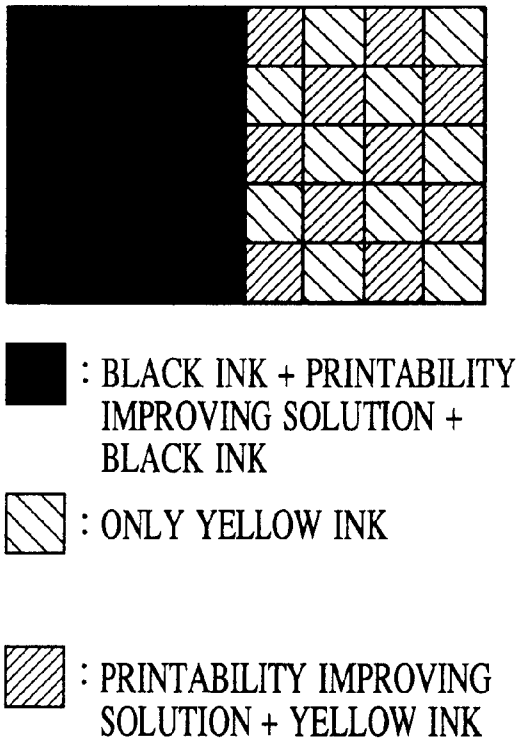

FIGS. 9A through 9C are schematic illustrations of discharge of the printability improving solution on the black and color images. FIG. 9A is a schematic plan view of a printing section composed of a black image and an yellow image as a color image. FIG. 9B represents a pattern, in which the printability improving solution is discharged on the image shown in FIG. 9A based on the condition described above. FIG. 9C represents the discharge state for every pixel with respect to the printability improving agent, black ink and yellow ink in the image finally obtained.

In this embodiment, a discharge pattern set forth in FIG. 6B was used for discharging the printability improving solution on the color image. Different curtailing patterns may be used for individual colors of yellow, magenta and cyan.

According to this embodiment, a sharp, high density black image as in Embodiment 1 described above and a clear color image without bleeding or color mixing at the boundaries between the black image and color image is achieved. Both the black and color images have high water resistance.

In this invention, the printability improving solution contains a cationic material comprising a low molecular weight component and a high molecular weight component. The ink contains a dye comprising an anionic material, or an anionic compound and a pigment.

The printability improving solution to insolubilize the ink dye can be obtained, for example, as follows.

After mixing and dissolving the following components, the solution is filtered under pressure through a membrane filter (Fluoropore filter (commercial name) made by Sumitomo Electric Industries, Ltd.) having a pore size of 0.22 $\mu$m and is adjusted to a pH of 4.8 with a NaOH solution to prepare a printability improving solution.

| [Components of Printability Improving Solution] | |
|---|---|
| A low molecular weight component of a cationic compound<br>A stearyltrimethylammonium salt (Commercial name: Electrostripper QE made by Kao Corporation) or<br>Stearyltrimethylammonium chloride (Commercial name: Quatamin 86P made by Kao Corporation) | 2.0 parts by weight |
| A high molecular weight component of a cationic compound<br>A copolymer of a diarylamine hydrochloric acid salt and sulfur dioxide<br>(Average molecular weight: 5,000)<br>(Commercial name: Poylaminesulfon PAS-92 made by Nitto Boseki Co., Ltd.) | 3.0 parts by weight |
| Thiodiglycol | 10 parts by weight |
| Water | the balance |

Preferable examples of inks which can mixed and insolubilized with the printability improving solution are as follows:

The following components are mixed and filtered under pressure through a membrane filter (Fluropore filter (commercial name) made by Sumitomo Electric Industries, Ltd.) having a pore size of 0.22 $\mu$m to prepare a yellow ink Y1, a magenta ink M1, a cyan ink C1 and a black ink K1.

| Y1 | |
|---|---|
| C.I. Direct Yellow 142 | 2 parts by weight |
| Thiodiglycol | 10 parts by weight |
| Acetylenol | 0.05 parts by weight |
| Water | the balance |

M1

The same compositions as Y1, except that 2.5 parts by weight of C.I. Acid Red 289 is used instead of C.I. Direct Yellow 142.

C1

The same composition as Y1, except that 2.5 parts by weight of C.I. Acid Blue 9 is used instead of C.I. Direct Yellow 142.

K1

The same composition as Y1, except that 3 parts by eight of C.I. Food Black 2 is used instead of C.I. Direct Yellow 142.

In the mixing step of the printability improving solution with the ink on or in the printing material, the low molecular weight cationic compound in the printability improving solution associates with the water-soluble dyes having anionic groups in the ink due to ionic interaction and momentarily separates from the liquid phase, as a first reaction step.

In a second reaction step, the association product composed of the dyes and the low molecular weight cationic compound is adsorbed into the high molecular weight component in the printability improving solution, thereby further increasing the size of the dye aggregate formed due to association. Thus, the dye aggregate barely penetrates into spaces between fibers of the printing material. As a result, only the separated liquid component penetrates into the printing material. A high printing quality and fixing characteristic can be simultaneously achieved in such a manner. Since the dye aggregate formed due to the above-mentioned mechanism has a high viscosity and stays at the discharged site apart from the liquid component, two adjacent ink dots of different colors do not mix with each other and no bleeding occurs in full color image formation. Since the dye aggregate is water-insoluble, the resulting image has high water resistance. Further, the image has good light resistance due to the light shielding effects of the polymer contained in the dye aggregates.

As used herein, "insolubilization", "aggregate" and related words are used for describing both phenomena which occur in the first and second steps.

In the present invention, no cationic polymer or multivalent metal salt is generally used, in contrast to conventional methods, but a minimal amount of such materials may be additionally used in order to further improve the advantages set forth above. Thus, another advantage of the present invention is that it is free from decreased dye coloring which is inevitable when achieving high water resistance by using a conventional cationic polymer or a multivalent metal salt.

The printing materials preferably used in the present invention are not limited and include so-called plain paper such as copying paper and bond paper. Coated paper particularly prepared for ink jet printing and transparent films for OHP, as well as wood-free paper and gloss paper, can also be preferably used.

[Embodiment 7]

In this embodiment, the following printability improving solution was used instead of the printability improving solution of Embodiment 1.

| Printability Improving Solution | |
|---|---|
| 1. Glycerin | 7.00 parts by weight |
| 2. Diethylene glycol | 5.00 parts by weight |
| 3. Polyarylamine (15% aqueous solution) | 24.00 parts by weight |
| 4. Acetic acid (10% aqueous solution) | 3.51 parts by weight |
| 5. Benzalkonium chloride (51% aqueous solution) | 1.92 parts by weight |
| 6. Triethylene glycol monobutyl ether | 0.95 parts by weight |
| 7. Deionized water | 57.62 parts by weight |

The resulting printability improving solution had a surface tension of 34.0 dyn/cm.

[Embodiment 8]

A printability improving solution having the following composition was prepared instead of the printability improving solution in Embodiment 1.

1. Fluorine surfactant (a perfluoroalkyltrimethylammonium salt, commercial name: Surflon, made by Asahi Glass Co., Ltd.)

| | |
|---|---|
| 1. Fluorine surfactant (a perfluoroalkyltrimethylammonium salt, commercial name: Surflon, made by Asahi Glass Co., Ltd.) | 0.001 parts by weight |
| 2. Polyarylamine hydrochloric acid salt (commercial name: PAA-HCl-1L, made by Nitto Boseki Co., Ltd.) | 4.0 parts by weight |
| 3. Diethylene glycol | 20 parts by weight |
| 4. Deionized water | the balance |

The resulting printability improving solution had a surface tension of 28 dyn/cm.

[Embodiment 9]

A printability improving solution having the following composition was prepared instead of the printability improving solution in Embodiment 1.

| | | |
|---|---|---|
| 1. | Acetylenol | 0.05 parts by weight |
| 2. | Polyarylamine hydrochloric acid salt (commercial name: PAA-HCl-1L, made by Nitto Boseki Co., Ltd.) | 4.0 parts by weight |
| 3. | Diethylene glycol | 20 parts by weight |
| 4. | Deionized water | the balance |

The resulting printability improving solution had a surface tension of 41 dyn/cm.

Three other printability improving solutions, each having a surface tension of 30, 32 and 40 dyn/cm, respectively, were prepared. Using these printability improving solutions together with the ink of Embodiment 1, printing was performed by the ink jet printing apparatus used in Embodiment 1. A preferable surface tension $\gamma$ (dyn/cm) is 40 or less in view of fixing characteristics, and 30 or more in view of image quality. Thus, compatibility of excellent fixing characteristics and high image quality can be achieved at $30 \leqq \gamma \leqq 40$. The surface tension range is more preferably $30 \leqq \gamma \leqq 38$, and is most preferably $30 \leqq \gamma \leqq 36$ in view of fixing characteristics.

Fixing characteristics were evaluated as follows. Five sheets of "Silbon C" (made by Kojin Inc. and used as lens cleaning paper) were overlapped on the printed surface of the recording paper after printing, a weight of 40 g/cm$^2$ (bottom size: 3.5 cm by 3.5 cm) was loaded on the sheets, then the sheets were moved at a rate of 15 cm/sec. Blur of the printed surface was visually determined.

The image quality was evaluated by optical density measured with a Macbeth densitometer and visual observation of feathering.

The surface tension was determined with a Kyowa CBVP surface tension meter A-1 (made by Kyowa Interface Science Co., Ltd.) at a temperature of 25±0.2° C. using approximately 5 to 6 ml of ink or printability improving solution placed in a petri dish.

In the above embodiments, "Acetylenol EH" is a trademark of Kawaken Fine Chemicals Co., Ltd. and its chemical name is ethylene oxide-2,4,7,9-tetramethyl-5-decyne-4,7-diol.

The method and apparatus in accordance with the present invention are very effective for an ink jet print head or ink jet printing apparatus which is provided with a thermal energy generating means, e.g. an electrothermal transducer or laser light beam, for changing the state of, and discharging, the ink or the printability improving solution. High density, high precision printing can be achieved by such a method and apparatus. Each of the nozzle groups may be provided with a thermal energy generator for generating thermal energy to discharge the ink or solution.

Typical configurations and principles of this ink jet printing system are disclosed in, for example, U.S. Pat. Nos. 4,723,129 and 4,740,796. This system is applicable to both the so-called on-demand type and the continuous type, and is particularly effective for the on-demand type, in which an electrothermal transducer displaced along an ink channel is rapidly heated to a temperature above the nucleus boiling point by applying at least one drive signal in response to printing information resulting in a membrane boiling phenomenon on the heat-affected face of the print head and a bubble forming in the ink in response to the drive signal. Bubble expansion and shrinkage cause ink discharge and form at least on droplet. When using a pulse drive signal, bubble expansion and shrinkage will instantaneously occur and ink is discharged in a manner highly responsive to the drive signal. Suitable pulse drive signals are disclosed in U.S. Pat. Nos. 4,463,359 and 4,345,262. Conditions regarding the temperature rising rate of the heat-affected face disclosed in U.S. Pat. No. 4,313,124 further improve printability.

Each print head disclosed in these patents comprises a discharge port, an ink channel, and an electrothermal transducer. Other print head configurations are also applicable to the present invention. For example, U.S. Pat. Nos. 4,558,333 and 4,459,600 disclose a print head configuration in which a heat-affected section is located at a bending region. Further, Japanese Unexamined Patent Publication No. 59-123,670 discloses a common slit as a discharge section of a plurality of electrothermal transducers, and Japanese Unexamined Patent Publication No. 59-138,461 disclosed an opening which absorbs compression waves due to thermal energy and is located corresponding to a discharge section. In the present invention, all print heads noted above are effectively used.

The present invention is also applicable to a full-line type print head having a width corresponding to the maximum width of a printing medium. The full-line type print head may be composed of a plurality of print heads or an integrally fabricated print head unit.

In a serial type printer, the print head may be a fixed type print head which is fixed to the printer main body, a chip type print head which is loaded on the printer and is capable of electrical connection to the printer and ink supply from the printer, or a cartridge type print head having an ink reservoir integrally fabricated into it.

It is preferable that the print head be provided with a recovery means, and other additional means in order to achieve further stable printing in the present invention. Examples of such means include a capping means, a cleaning means, a pressing and suction means, a preliminary heating means composed of an electrothermal transducer, another heating device or a combination thereof, and a preliminary discharge means other than printing.

The kind and number of the print head are appropriately determined corresponding to the printing mode. For example, only one head is used for mono-color printing, and a plurality of heads are used for multi-color printing using inks with different colors or different densities. Print modes of the printer in the present invention include main color printing such as black printing and full color printing by means of different color inks or color mixing using an integrally fabricated print head unit or a plurality of print heads.

In the embodiments set forth above, the ink employed is a liquid. Other ink media can also be used in the present invention. Examples of such ink media include an ink which has a solidifying point below room temperature and a softening or liquefying point at room temperature, and an ink which liquefies when applying a print signal. The latter ink is preferable because the ink temperature is regulated within a temperature range between 30° C. and 70° C. to stably discharge in the ink jet system. A solid ink which liquefies by means of thermal energy has the following additional advantages: Excessive thermal energy is absorbed due to liquefaction of the solid ink and temperature rising can be prevented thereby. The solid ink does not vaporize at room temperature. The discharged ink can immediately solidify on the printing material. Such an ink may be held as a solid or liquid in a porous sheet groove or in a through hole opposing an electrothermal transducer, as described in Japanese Unexamined Patent Publication Nos. 54-56,847 and 60-71,260. The most preferable system suitable for the inks described above is the above-mentioned membrane boiling system.

Examples of printing apparatus using an ink jet print head in accordance with the present invention include image output terminals of information processing machines such as computers, copying machines with reading units, and facsimile units provided with a transmitter-receiver.

Figure 10:
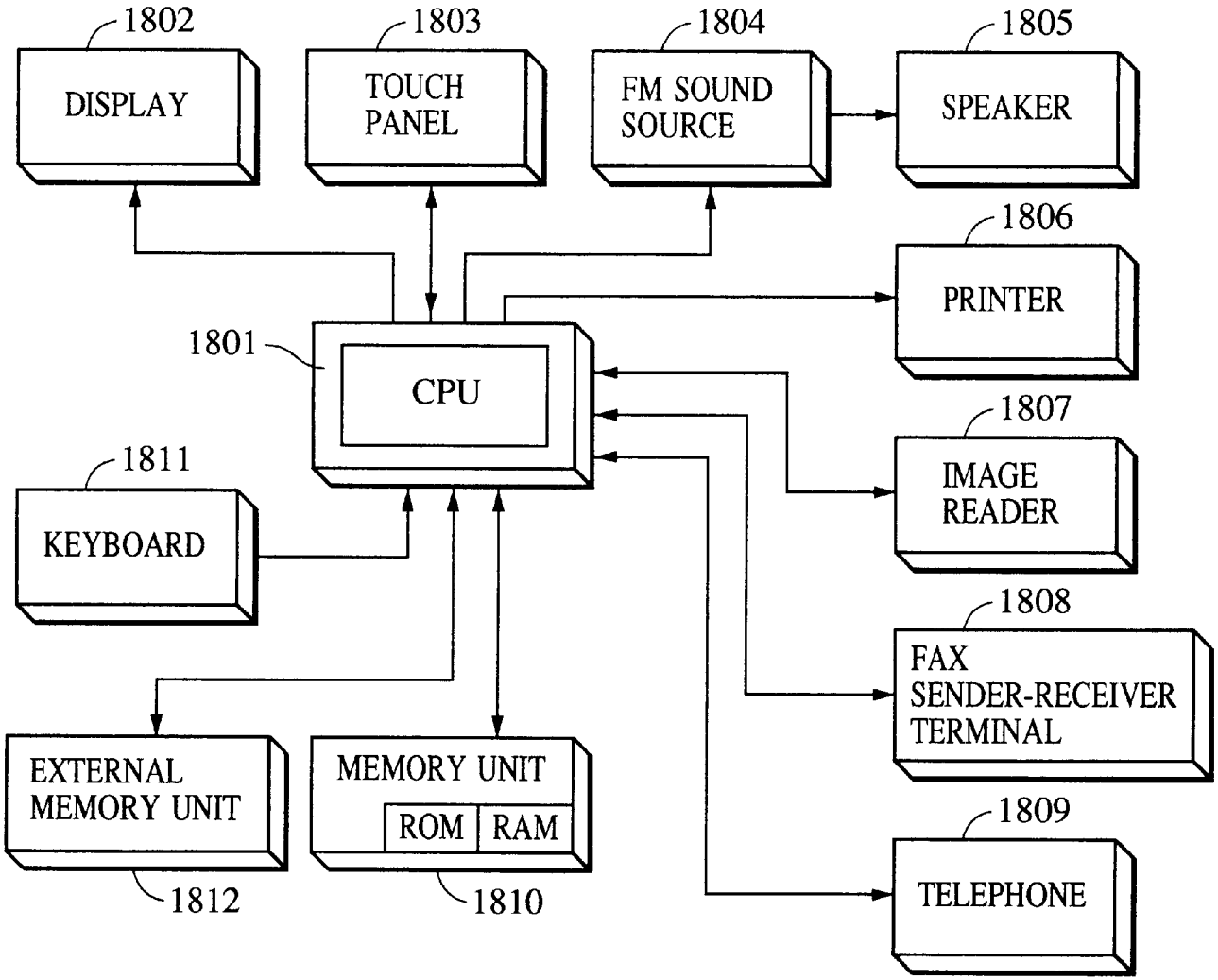
FIG. 10 is a block diagram illustrating an information processing apparatus configuration having functions of a word processor, personal computer, facsimile and copying machine, provided with a printing apparatus in accordance with the present invention.

FIG. 10 is a block diagram of a printing apparatus in accordance with the present invention applied to an information processing apparatus having functions of a word processor, a personal computer, a facsimile and a copying machine.

A control unit 1801 is provided with a CPU, such as a microprocessor, and various I/O port. It comprehensively controls the information processing apparatus by transmitting control signals and data signals to these sections and by receiving control signals and data signals from these sections. A display 1802 displays various menus, document information, and image data read by an image reader 1807. A clear, pressure-sensitive touch panel 1803 is provided on the display 1802 to input various parameters, coordinates and the like by means of finger touching.

An FM (frequency modulation) sound source 1804 reads out digital data of music information, which was made by a music editor and stored in a memory unit 1810 or an external memory unit 1812, to perform frequency modulation. Electrical signals from the FM sound source 1804 are converted to audible tones through a speaker 1805. A printer 1806 is composed of a printing apparatus in accordance with the present invention and is used as an output terminal of the word processor, personal computer, facsimile and copying machine.

An image reader 1807 is provided midway in the travelling path of a document and optoelectrically reads document data for a facsimile, copying machine and the like. A fax sender-receiver terminal 1808 has an interface function to the external machines, and performs facsimile transmitting of the document data read by the image reader 1807 and receiving and decoding of facsimile signals sent from the other machines. A telephone 1809 has various functions such as a general telephone, an answering machine and the like.

A memory unit 1810 includes ROM units for storing system programs, management programs, other application programs, character fonts, dictionaries and the like, and RAM units for storing application programs, document information and video information loaded from an external memory unit 1812. The external memory unit 1812 is composed of flexible disks, hard disks and the like, and stores document information, music and/or sound information, user's application programs and the like. The control unit 1801 is further provided with a keyboard 1811 for inputting document information and various commands and parameters.

Figure 11:
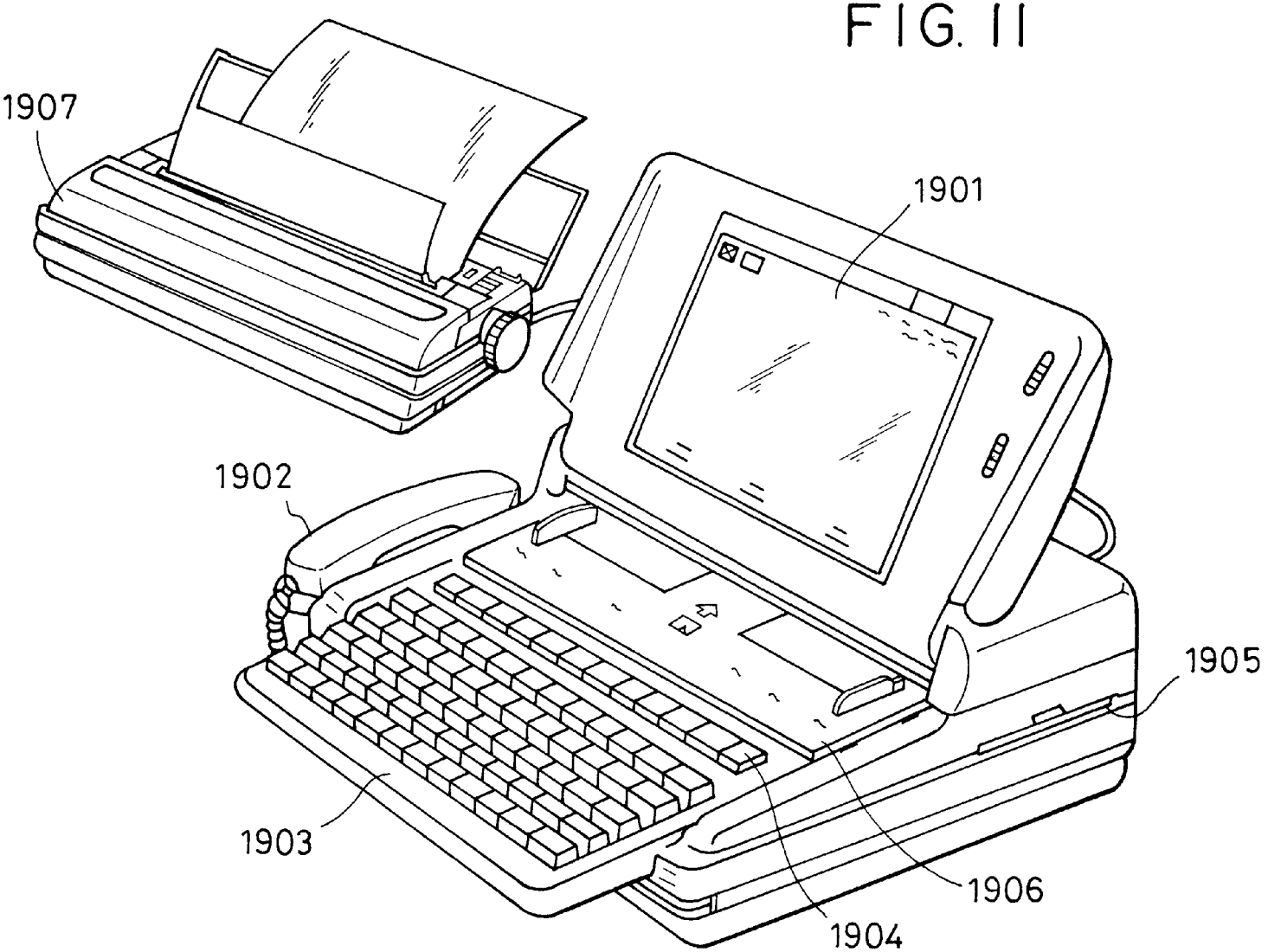
FIG. 11 is a perspective view of the information processing apparatus of FIG. 10.

FIG. 11 is a perspective view of the information processing apparatus of FIG. 10. The flat panel liquid crystal display 1901 displays various menus, image and document information. The display 1901 is provided with a touch panel 1803 thereon (shown diagrammatically in FIG. 10), and is used for inputting coordinates and various parameters by finger touching. The hand-set telephone 1902 is used when the information processing apparatus works as a telephone. The keyboard 1903 is detachably connected to the main body through a code and used for inputting various documents and data. The keyboard 1903 is provided with various function keys 1904, and a flexible disk drive unit 1905 as the external memory unit 1812.

The keyboard 1903 is provided with a paper feeder 1906 which feeds a document to be read by the image reader 1807 and ejects it to the rear side of the keyboard 1903. The ink jet printer 1907 prints various information from, for example, the facsimile.

The display 1802 may be a CRT, but is preferably a flat panel type such as a liquid crystal display using a ferroelectric liquid crystal in order to achieve a compact, thin and lightweight display.

When using the information processing apparatus as a personal computer or a word processor, various information input through the keyboard 1811 is processed with a give program in the control unit 1801 and output to the printer 1806 as an image.

When using the apparatus as a facsimile receiver, facsimile information input from the fax sender-receiver terminal 1808 via a communication line is process with a given program in the control unit 1801 and output to the printer 1806 as a received image.

When using the apparatus as a copying machine, the image reader 1807 reads a document and the printer 1806 outputs the read data as a copying image under control of the control unit 1801. When using the apparatus as a facsimile transmitter, document data read with the image reader 1807 is encoded by a given program in the control unit 1801 and transmitted to a communication line through the fax sender-receiver terminal 1808.

Figure 12:
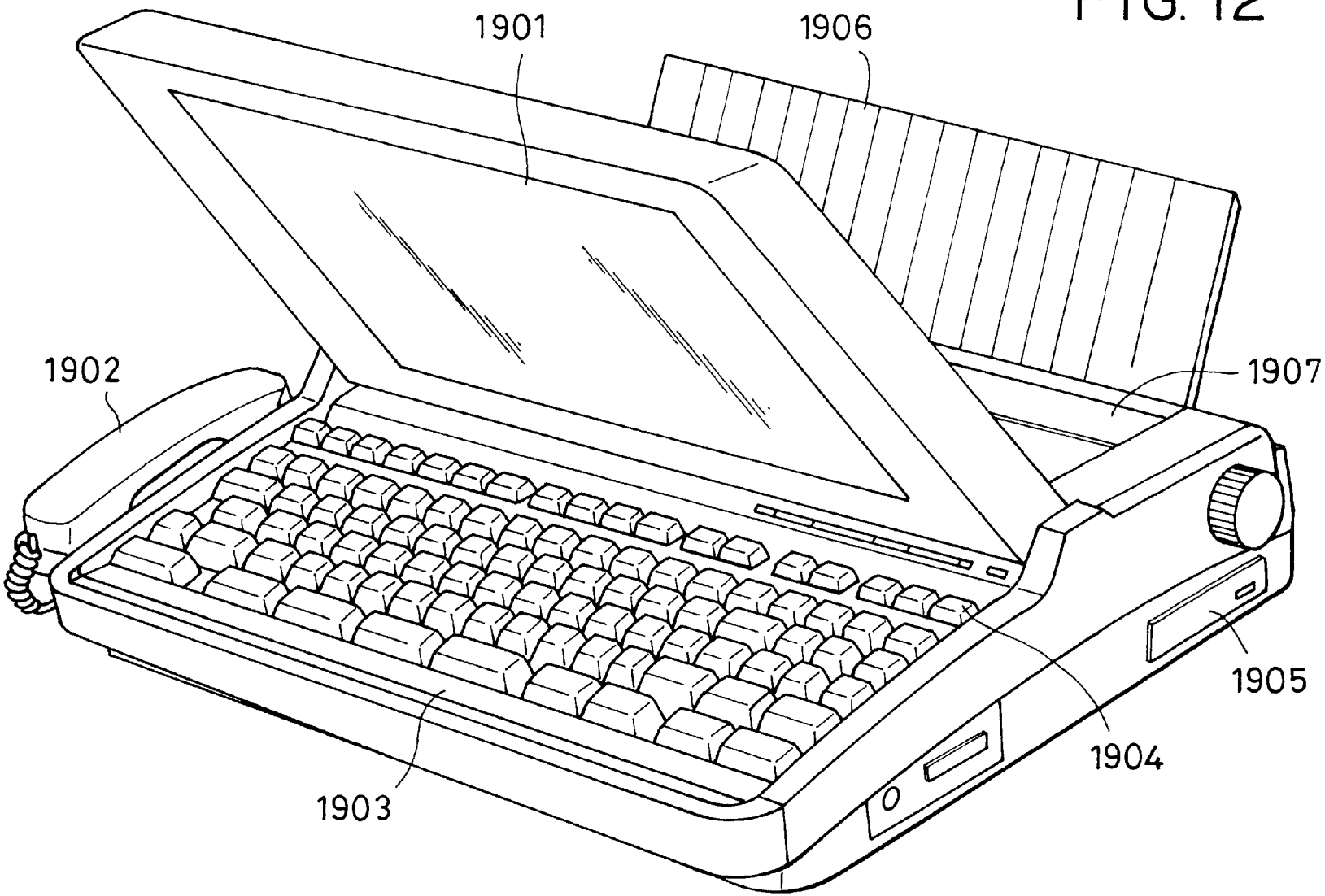
FIG. 12 is a perspective view of an information processing apparatus using a printing apparatus in accordance with the present invention.

The information processing apparatus described above may be an integral type in which an ink jet printer is installed inside the main body in FIG. 12, to provide portability. In FIG. 12, parts having the same function as in FIG. 11 are referred to with the same identification numbers.

When applying a printing apparatus in accordance with the present invention to a multifunctional information processing apparatus, high quality printed images are rapidly obtainable with low noise, resulting in improved function of the information processing apparatus.

The present invention provides a method and an apparatus for ink jet printing which achieves high quality images with excellent fixing characteristics when forming images on a printing material using as ink or inks with a printability improving solution.

The invention may be embodied in other specific forms without departing from the spirit or essential characteristics thereof. The present embodiments and examples are therefore to be considered in all respects as illustrative and not restrictive, the scope of the invention being indicated by the appended claims rather than by the foregoing description and all changes within the meaning and range of equivalency of the claims are intended to be embraced therein.

What is claimed is:

1. A method for ink jet printing comprising the steps of:

providing an ink jet printing apparatus for forming an image using a print head comprising:

a first nozzle group for discharging a first ink to develop a first color;

a second nozzle group for discharging a second ink to develop the first color;

a third nozzle group for discharging a printability improving solution to improve printability of said first ink and said second ink;

said first nozzle group, said second nozzle group and said third nozzle group being arranged along a relative moving direction of said print head to a printing medium, said third nozzle group being arranged between said first nozzle group and said second nozzle group;

forming an image by discharging a first ink from said first nozzle group onto said printing medium based on image data;

discharging a printability improving solution having a faster rate of penetration into said printing medium compared to said first ink and containing a material to insolubilize or coagulate a coloring material in said first ink from said third nozzle group onto said image; and discharging a second ink from said second nozzle group onto said image.

2. A method for ink jet printing according to claim 1, wherein said first ink and said second ink have a like composition.

3. A method for ink jet printing according to claim 1, wherein said discharging of said printability improving solution is based on said image data.

4. A method for ink jet printing according to claim 1, wherein said discharging of said printability improving solution is based on modified data obtained from said image data such that said modified data comprises fewer data points than said image data.

5. A method for ink jet printing according to claim 1, wherein said steps of forming an image by discharging said first ink, discharging said printability improving solution, and discharging said second ink are performed in order, and a discharge volume of said first ink discharged from said first nozzle group in said forming step is larger than a discharge volume of said second ink discharged from said second nozzle group in said step of discharging said second ink.

6. A method for ink jet printing according to claim 5, wherein the discharge volume of said first ink discharged from said first nozzle group is larger than the discharge volume of said second ink.

7. A method for ink jet printing according to claim 5, wherein the discharge volume of said first ink discharged from said first nozzle group is made larger than the discharge volume of said second ink discharged from said second nozzle group, by increasing the size of discharge openings of said first nozzle group relative to discharge openings of said second nozzle group.

8. A method for ink jet printing according to claim 1, wherein said steps of forming an image by discharging said first ink, discharging said printability improving solution, and discharging said second ink are performed in order, and a discharge rate of said first ink discharged from said first nozzle group in said forming step is larger than a discharge rate of said second ink discharged from said second nozzle group in said step of discharging said second ink.

9. A method for ink jet printing according to claim 8, wherein said first nozzle group and said second nozzle group are each operatively connected to printheads and said method further comprises submitting pulse waveforms to said printheads such that the discharge rate of said first ink discharged from said first nozzle group is larger than the discharge rate of said second ink discharged from said second nozzle group.

10. A method for ink jet printing according to claim 9, wherein the discharge rate of said first ink discharged from said first nozzle group is made larger than the discharge rate of said second ink discharged from said second nozzle group, by increasing the size of discharge openings of said first nozzle group relative to discharge openings of said second nozzle group.

11. A method for ink jet printing according to claim 1, wherein each of said first nozzle group, said second nozzle group and said third nozzle group is provided with a thermal energy generator for generating thermal energy to discharge said ink or said printability improving solution.

12. A method for ink jet printing according to claim 1, wherein said printability improving solution contains a cationic material comprising an ionic compound and a polymer, and said link contains a dye comprising an anionic material.

13. A method for ink jet printing according to claim 1, wherein said printability improving solution contains a cationic material comprising an ionic compound and a polymer, and said ink contains an anionic dye, or contains an anionic compound and a pigment.

14. A method for ink jet printing according to claim 1, wherein said printability improving solution has a surface tension $\gamma$, in dyn/cm, within a range $30 \leqq \gamma \geqq 40$.

15. A method for ink jet printing according to claim 14, wherein said surface tension $\gamma$ is within a range of $30 \leqq \gamma \leqq 38$.

16. A method for ink jet printing according to claim 14, wherein said surface tension $\gamma$ is within a range of $30 \leqq \gamma \leqq 36$.

17. A method for ink jet printing according to claim 1, wherein said first ink contains a black coloring material.

18. An ink jet printing apparatus for forming an image comprising a print head comprising:

a first nozzle group discharging a first ink to develop a first color;

a second nozzle group discharging a second ink to develop the first color;

a third nozzle group discharging a printability improving solution having a faster rate of penetration into a printing medium compared to said first ink and said second ink to improve printability of said first ink and said second ink and containing a material to insolubilize or coagulate a coloring material in said first ink;

said first nozzle group said second nozzle group and said third nozzle group being arranged in a relative moving direction of said print head to said printing medium, said third nozzle group being arranged between said first nozzle group and said second nozzle group, each of said first nozzle group, said second nozzle group, and said third nozzle group being operatively connected to a driver;

wherein said ink jet printing apparatus further comprises a control unit operatively connected to said driver for controlling discharge operation of said first nozzle group, said second nozzle group and said third nozzle group such that said first nozzle group discharges said first ink onto said printing medium based on image data to form an image;

said third nozzle group discharges said printability improving solution onto said image; and said second nozzle group discharges said second ink onto said image.

19. An ink jet printing apparatus according to claim 18, wherein each of said first nozzle group, said second nozzle group and said third nozzle group is provided with a thermal energy generator for generating thermal energy to discharge said ink or said printability improving solution.

20. An ink jet printing apparatus according to claim 18, wherein said printability improving solution contains a cationic material comprising an ionic compound and a polymer, and said ink contains a dye comprising an anionic material.

21. An ink jet printing apparatus according to claim 18, wherein said printability improving solution contains a cationic material comprising an ionic compound and a polymer, and said ink contains an anionic dye, or contains an anionic compound and a pigment.

22. An ink jet printing apparatus according to claim 18, wherein said printability improving solution has a surface tension $\gamma$, in dyn/cm, within a range $30 \leqq \gamma \geqq 40$.

23. An ink jet printing apparatus according to claim 22, wherein said surface tension $\gamma$ is within a range of $30 \leqq \gamma \leqq 38$.

24. An ink jet printing apparatus according to claim 22, wherein said surface tension $\gamma$ is within a range of $30 \leqq \gamma \leqq 36$.

25. An ink jet printing apparatus according to claim 18, wherein said first ink contains a black coloring material.

* * * * *

UNITED STATES PATENT AND TRADEMARK OFFICE

CERTIFICATE OF CORRECTION

PATENT NO. : 6,074,052
DATED : June 13, 2000
INVENTOR(S) : Toshiharu Inui et al.

It is certified that error appears in the above-identified patent and that said Letters Patent is hereby corrected as shown below:

Title page,
Item [56], References Cited, FOREIGN PATENT DOCUMENTS,
-- 63-299971 7/1988 Japan. -- should be inserted.

Column 1,
Line 16, "over head" should read -- overhead --.

Column 2,
Line 27, "No: 3-146,355" should read -- No. 3-146,355 --.

Column 4,
Line 51, "improvement" should read -- "Improvement --.

Column 11,
Line 18, "a" should be deleted.

Column 14,
Lines 39-41, should be deleted (duplication).

Column 15,
Line 65, "on" should read -- one --.

Column 18,
Line 21, "give" should read -- given --.

Column 20,
Line 15, "link" should read -- ink --.
Line 24, "range" should read -- range of --.

UNITED STATES PATENT AND TRADEMARK OFFICE

CERTIFICATE OF CORRECTION

PATENT NO. : 6,074,052
DATED : June 13, 2000
INVENTOR(S) : Toshiharu Inui et al.

It is certified that error appears in the above-identified patent and that said Letters Patent is hereby corrected as shown below:

Column 22,
Line 3, "range" should read -- range of --.

Signed and Sealed this

Fifth Day of March, 2002

*Attest:*

*Attesting Officer*

JAMES E. ROGAN
*Director of the United States Patent and Trademark Office*